US006074602A

United States Patent [19]

Wukusick et al.

[11] Patent Number: 6,074,602

[45] Date of Patent: Jun. 13, 2000

[54] PROPERTY-BALANCED NICKEL-BASE SUPERALLOYS FOR PRODUCING SINGLE CRYSTAL ARTICLES

[75] Inventors: Carl Stephen Wukusick, Cincinnati; Leo Buchakjian, Jr., Loveland, both of Ohio

[73] Assignee: General Electric Company, Cincinnati, Ohio

[21] Appl. No.: 08/270,528

[22] Filed: Jul. 5, 1994

Related U.S. Application Data

[63] Continuation of application No. 08/152,077, Nov. 15, 1993, abandoned, which is a continuation of application No. 08/056,597, May 3, 1993, abandoned, which is a continuation of application No. 07/668,816, Mar. 8, 1991, abandoned, which is a continuation of application No. 07/253,097, Sep. 23, 1988, abandoned, which is a division of application No. 06/790,439, Oct. 15, 1985, abandoned.

[51] Int. Cl.[7] ..... C22C 19/05

[52] U.S. Cl. ..... 420/443; 420/448; 148/410

[58] Field of Search ..... 148/410, 428; 420/443, 448, 449, 450

[56] References Cited

U.S. PATENT DOCUMENTS

| | | | |
|---|---|---|---|
| 3,260,505 | 7/1966 | Ver Snyder | 253/77 |
| 3,494,709 | 2/1970 | Piercey | 416/232 |
| 3,619,182 | 11/1971 | Bleber et al. | 75/171 |
| 3,904,402 | 9/1975 | Smashey | 420/445 |
| 4,031,945 | 6/1977 | Gigliotti | 148/404 |
| 4,116,723 | 9/1978 | Gell et al. | 148/3 |
| 4,152,488 | 5/1979 | Schilke et al. | 428/678 |
| 4,162,918 | 7/1979 | Huseby | 148/404 |
| 4,169,742 | 10/1979 | Wukusick et al. | 148/404 |
| 4,209,348 | 6/1980 | Duhl et al. | 148/3 |
| 4,222,794 | 9/1980 | Schweizer et al. | 148/3 |
| 4,261,742 | 4/1981 | Coupland et al. | 75/134 |
| 4,371,404 | 2/1983 | Duhl et al. | 148/3 |
| 4,402,772 | 9/1983 | Duhl et al. | 148/404 |
| 4,522,664 | 6/1985 | Gigliotti et al. | 148/404 |
| 4,582,548 | 4/1986 | Harris et al. | 148/404 |
| 4,589,937 | 5/1986 | Jackson et al. | 148/404 |
| 4,639,280 | 1/1987 | Fredholm et al. | 148/404 |
| 4,643,782 | 2/1987 | Harris et al. | 148/404 |
| 4,719,080 | 1/1988 | Duhl et al. | 420/443 |
| 4,849,030 | 7/1989 | Durolia et al. | 148/404 |
| 5,043,138 | 7/1991 | Darolia et al. | 420/443 |
| 5,077,141 | 12/1991 | Nalk et al. | 148/404 |
| 5,100,484 | 3/1992 | Wukusick et al. | 148/410 |
| 5,399,313 | 3/1995 | Ross et al. | 148/404 |
| 5,455,120 | 10/1995 | Walston et al. | 148/410 |

FOREIGN PATENT DOCUMENTS

| | | |
|---|---|---|
| 0155827 | 8/1985 | European Pat. Off. . |
| 0208645 | 1/1987 | European Pat. Off. . |
| 0225837 | 6/1987 | European Pat. Off. . |
| 2749080 | 5/1978 | Germany . |
| 2817321 | 11/1978 | Germany . |
| 2821524 | 12/1978 | Germany . |
| 2949158 | 6/1980 | Germany . |
| 3234083 | 4/1983 | Germany . |
| 3234090 | 4/1983 | Germany . |
| 3248134 | 7/1983 | Germany . |
| 3114253 | 7/1985 | Germany . |
| 3023576 | 7/1987 | Germany . |
| 1592237 | 7/1981 | United Kingdom . |
| 2105748 | 3/1983 | United Kingdom . |
| 2121312 | 7/1985 | United Kingdom . |
| 2112812 | 10/1985 | United Kingdom . |
| 2110240 | 3/1986 | United Kingdom . |

OTHER PUBLICATIONS

Metals Handbook vol. 5 8th Ed pp. 237–261, Oct. 1970.

*Primary Examiner*—Scott Kastler
*Attorney, Agent, or Firm*—Andrew C. Hess; David L. Narciso

[57] ABSTRACT

The present invention is directed to the achievement of increased gas turbine engine efficiencies through further improvements in nickel-base superalloys used to make parts and components for gas turbine engines. The present invention comprises nickel-base superalloys for producing single crystal articles having a significant increase in temperature capability, based on stress rupture strength and low and high cycle fatigue properties, over single crystal articles made from current production nickel-base superalloys. Further, because of their superior resistance to degradation by cyclic oxidation, and their resistance to hot corrosion, the superalloys of this invention possess a balance in mechanical and environmental properties which is unique and has not heretofore been obtained.

47 Claims, No Drawings

PROPERTY-BALANCED NICKEL-BASE SUPERALLOYS FOR PRODUCING SINGLE CRYSTAL ARTICLES

This application is a continuation of Ser. No. 08/152,077, now abandoned, filed on Nov. 15, 1993, which is a continuation of Ser. No. 08/056,597, filed on May 3, 1993, now abandoned, which is a continuation of Ser. No. 07/668,816 filed on Mar. 8, 1991, now abandoned, which is a continuation of Ser. No. 07/253,097 filed on Sep. 23, 1988, now abandoned, which is a divisional of Ser. No. 06/790,439 filed on Oct. 15, 1985, now abandoned.

The invention disclosed and claimed herein is related to the invention disclosed and claimed in co-assigned application Ser. No. 595,854 filed on Apr. 2, 1984. The invention disclosed and claimed herein is also related to the invention disclosed and claimed in co-assigned application Ser. No. 07/577,668 filed on Sep. 5, 1990.

This invention pertains generally to nickel-base superalloys castable as single crystal articles of manufacture, which articles are especially useful as hot-section components of aircraft gas turbine engines, particularly rotating blades.

The efficiency of gas turbine engines depends significantly on the operating temperature of the various engine components with increased operating temperatures resulting in increased efficiencies. One means by which the operating temperature capability can be increased is by casting the components which operate at the highest temperatures, e.g., turbine blades and vanes, with complex hollow passageways therein so that cooling air can be forced through the component and out through holes in the leading and trailing edges. Thus, internal cooling is achieved by conduction and external cooling is achieved by film or boundary layer cooling.

The search for increased efficiencies has also led to the development of heat-resistant superalloys which can withstand increasingly high temperatures yet maintain their basic material properties. Oftentimes, the development of such superalloys has been done in conjunction with the design, development and manufacture of the aforementioned cast components having intricate air cooling passageways therein.

The present invention is directed to the achievement of increased efficiencies through further improvements in nickel-base superalloys. According, there is provided by the present invention nickel-base superalloys for producing single crystal articles having a significant increase in temperature capability, based on stress rupture strength and low and high cycle fatigue properties, over single crystal articles made from current production nickel-base superalloys. Further, because of their superior resistance to degradation by cyclic oxidation, and their resistance to hot corrosion, the superalloys of this invention possess a balance in mechanical and environmental properties which is unique and has not heretofore been obtained.

According to the present invention, superalloys suitable for making single-crystal castings comprise the elements shown in Table I below, by weight percent (weight %), with the balance being nickel (Ni) plus incidental impurities:

TABLE I

ALLOY COMPOSITIONS (weight %)

| Elements | Base | Preferred | Most Preferred |
|---|---|---|---|
| Chromium (Cr): | 5–10 | 6.75–7.25 | 7.0 |
| Cobalt (Co): | 5–10 | 7.0–8.0 | 7.5 |
| Molybdenum (Mo): | 0–2 | 1.3–1.7 | 1.5 |
| Tungsten (W): | 3–10 | 4.75–5.25 | 5.0 |
| Tantalum (Ta): | 3–8 | 6.3–6.7 | 6.5 |
| Titanium (Ti): | 0–2 | 0.02 max | 0.0 |
| Aluminum (Al): | 5–7 | 6.1–6.3 | 6.2 |
| Rhenium (Re): | 0–6 | 2.75–3.25 | 3.0 |
| Hafnium (Hf): | 0–0.50 | 0.12–0.18 | 0.15 |
| Carbon (C): | 0–0.07 | 0.04–0.06 | 0.05 |
| Boron (B): | 0–0.015 | 0.003–0.005 | 0.004 |
| Yttrium (Y): | 0–0.075 | 0.005–0.030 | 0.01 |

The invention also includes cast single-crystal articles, such as gas turbine engine turbine blades and vanes, made of an alloy having a composition falling within the foregoing range of compositions.

There are two basic directional solidification (DS) methods now well-known in the art by which single crystal castings may be made. They generally comprise either the use of a seed crystal or the use of a labyrinthine passage which serves to select a single crystal of the alloy which grows to form the single crystal article ("choke" process).

In order to develop and test alloys of the invention, three series of 3000 gram heats of the alloys listed in Table II were vacuum induction melted and cast into 1½" dia. copper molds to form ingots. The ingots were subsequently remelted and cast into ½"×2"×4" single crystal slabs using the choke process, although the other previously mentioned process could have been used.

In a series of separate experiments, it was determined that yttrium retention in the single crystal slabs was about 30% of that present in the initial ingots. Hence, in preparing the series I, II, and III alloys shown in Table II, sufficient excess yttrium was added to the initially cast alloys so as to achieve the yttrium levels shown in Table II taking into account the 30% retention factor.

The series I alloys were designed to evaluate the interactions between tungsten, molybdenum and rhenium as gamma (γ) matrix alloying elements. The series II alloys were designed somewhat independently from series I in order to accommodate additional variables. Aluminum was maintained at a high level and titanium and tantalum were varied to accomplish a range of gamma prime (γ') levels up to about 63 volume percent and chromium was reduced in order to permit the increased γ' contents. Since it was determined that the 8% Cr series I alloys as a group were less stable than the series II alloys, the base Cr level was reduced from the 8% in series I to 7% to achieve better stability. Co was varied in alloys 812–814 to evaluate the effect of Co on stability.

The series III alloys were based on evaluations of the series I and II alloys. From series II, the upper limit in γ' content, based on γ' solutioning, was about 60 volume percent. Alloys 824–826 were based on alloy 820 which had 5.5% Re and high strength, but was unstable. Thus, the Re content was reduced to achieve stability. Alloys 827–829 were based on alloy 821 (0% Ti), but in which W and Re were varied. Alloys 830–833 were based on alloy 800 (1.5% Ti), but in which Re, W and Mo were varied. Alloys 834 and 835 contained increased Al at the expense of Ta and Ti. In all the series III alloys, the Co content was maintained at 10%, based on the evaluation of alloys 812–814 in series II.

The series I, II and III alloys were evaluated for stress rupture strength and the results of the tests are set forth in Table III. Prior to testing, the alloys, except for the "R" series noted in Table III, were heat treated as ½" thick single crystal slabs according to the following schedule: solutionizing at 2350–2400° F. for two hours to achieve solutioning of at least 95% of the γ' phase followed by an intermediate age at 1975° F. for 4 hrs. and a final age at 1650° F. for 16 hrs.

TABLE III

Stress Rupture (parallel to single crystal growth direction)

| ALLOY | ACO[1] | LIFE (HRS) 1600° F./ 80 Ksi | 1800° F./ 40 Ksi | 2000° F./ 20 Ksi | 2100° F./ 13 Ksi |
|---|---|---|---|---|---|
| 800 | | 94.5 | 68.5 | 184.5 | 90.4 |
| 801 | | 87.0 | 44.5 | 45.5 | 29.1 |
| 802 | | 86.8 | 63.1 | 90.0 | — |
| 803 | | 66.7 | 67.1 | 70.1 | 82.9 |
| 804 | | 54.2 | 103.0 | 52.4 | — |
| 805 | | 56.3 | 56.3 | 55.2 | 30.0 |

TABLE II (single crystal analyses)

| Alloy # | Cr | Co | Mo | W | Ta | Ti | Al | Re | Hf | B | C | Y |
|---|---|---|---|---|---|---|---|---|---|---|---|---|
| Series I | | | | | | | | | | | | |
| 800 | 8 | 7.5 | 1.5 | 4.0 | 5 | 1.5 | 5.8 | 3.0 | 0.15 | 0.004 | 0.05 | 0 |
| 801 | 8 | 7.5 | 0.5 | 5.9 | 5 | 1.5 | 5.75 | 3.0 | 0.15 | 0.004 | 0.05 | 0 |
| 802 | 8 | 7.5 | 0.0 | 5.9 | 5 | 1.5 | 5.75 | 3.0 | 0.15 | 0.004 | 0.05 | 0.015 |
| 803 | 8 | 7.5 | 0.0 | 4.0 | 5 | 1.5 | 5.75 | 4.5 | 0.15 | 0.004 | 0.05 | 0 |
| 804 | 8 | 7.5 | 0.0 | 2.0 | 5 | 1.5 | 5.75 | 6.0 | 0.15 | 0.004 | 0.05 | 0 |
| 805 | 8 | 7.5 | 3.65 | 0.0 | 5 | 1.5 | 5.9 | 3.1 | 0.15 | 0.004 | 0.05 | 0 |
| 896 | 8 | 7.5 | 3.0 | 0.0 | 5 | 1.5 | 5.8 | 4.5 | 0.15 | 0.004 | 0.05 | 0 |
| 807 | 8 | 7.5 | 1.5 | 3.0 | 6 | 1.0 | 6.0 | 3.0 | 0.15 | 0.004 | 0.05 | 0 |
| 808 | 8 | 7.5 | 1.5 | 3.0 | 6 | 0.0 | 6.5 | 3.0 | 0.15 | 0.004 | 0.05 | 0.015 |
| 809 | 8 | 7.5 | 0.0 | 4.0 | 6 | 0.0 | 6.4 | 4.5 | 0.15 | 0.004 | 0.05 | 0 |
| 810 | 8 | 7.5 | 0.0 | 2.0 | 6 | 0.0 | 6.4 | 6.0 | 0.15 | 0.004 | 0.05 | 0 |
| 811 | 8 | 7.5 | 3.0 | 0.0 | 6 | 0.0 | 6.4 | 4.5 | 0.15 | 0.004 | 0.05 | 0 |
| Series II | | | | | | | | | | | | |
| 812 | 7 | 5.0 | 1.5 | 3 | 6.0 | 1.0 | 6.0 | 3.0 | 0.15 | 0.05 | 0.004 | 0.015 |
| 813 | 7 | 7.5 | 1.5 | 3 | 6.0 | 1.0 | 6.0 | 3.0 | 0.15 | 0.05 | 0.004 | 0.015 |
| 814 | 7 | 10.0 | 1.5 | 3 | 6.0 | 1.0 | 6.0 | 3.0 | 0.15 | 0.05 | 0.004 | 0.015 |
| 815 | 5 | 7.5 | 1.5 | 3 | 7.5 | 0.5 | 6.5 | 3.0 | 0.15 | 0.05 | 0.004 | 0.015 |
| 816 | 5 | 7.5 | 1.5 | 3 | 8.0 | 0.5 | 6.5 | 3.0 | 0.15 | 0.05 | 0.004 | 0.015 |
| 817 | 5 | 7.5 | 0.5 | 3 | 8.0 | 1.0 | 6.5 | 3.0 | 0.15 | 0.05 | 0.004 | 0.015 |
| 818 | 5 | 7.5 | 1.5 | 3 | 7.0 | 0.5 | 6.5 | 3.5 | 0.15 | 0.05 | 0.004 | 0.015 |
| 819 | 5 | 7.5 | 1.5 | 3 | 7.0 | 0.5 | 6.5 | 4.5 | 0.15 | 0.05 | 0.004 | 0.015 |
| 820 | 5 | 7.5 | 1.5 | 3 | 7.0 | 0.0 | 6.5 | 5.5 | 0.15 | 0.05 | 0.004 | 0.015 |
| 821 | 7 | 7.5 | 1.5 | 5 | 6.5 | 0.0 | 6.2 | 3.0 | 0.15 | 0.05 | 0.004 | 0.015 |
| 822 | 6 | 7.5 | 1.5 | 5 | 6.5 | 0.0 | 6.2 | 3.0 | 0.15 | 0.05 | 0.004 | 0.015 |
| 823 | 5 | 7.5 | 1.5 | 5 | 6.5 | 0.0 | 6.2 | 3.0 | 0.15 | 0.05 | 0.004 | 0.015 |
| Series III | | | | | | | | | | | | |
| 824 | 5.0 | 10.0 | 1.5 | 6.5 | 7.0 | 0 | 6.5 | 2.0 | 0.15 | 0.004 | 0.05 | 0.015 |
| 825 | 5.0 | 10.0 | 1.5 | 5.5 | 7.0 | 0 | 6.5 | 3.0 | 0.15 | 0.004 | 0.05 | 0.015 |
| 826 | 5.0 | 10.0 | 1.5 | 4.0 | 7.0 | 0 | 6.5 | 4.0 | 0.15 | 0.004 | 0.05 | 0.015 |
| 827 | 7.0 | 10.0 | 1.5 | 5.0 | 6.5 | 0 | 6.2 | 3.0 | 0.15 | 0.004 | 0.05 | 0.015 |
| 828 | 7.0 | 10.0 | 1.5 | 6.0 | 6.5 | 0 | 6.2 | 2.5 | 0.15 | 0.004 | 0.05 | 0.015 |
| 829 | 7.0 | 10.0 | 1.5 | 7.0 | 6.5 | 0 | 6.2 | 2.0 | 0.15 | 0.004 | 0.05 | 0.015 |
| 830 | 7.0 | 10.0 | 1.5 | 5.0 | 5.0 | 1.5 | 5.8 | 3.0 | 0.15 | 0.004 | 0.05 | 0.015 |
| 831 | 7.0 | 10.0 | 1.5 | 6.0 | 5.0 | 1.5 | 5.8 | 2.0 | 0.15 | 0.004 | 0.05 | 0.015 |
| 832 | 7.0 | 10.0 | 1.5 | 7.0 | 5.0 | 1.5 | 5.8 | 1.0 | 0.15 | 0.004 | 0.05 | 0.015 |
| 833 | 7.0 | 10.0 | 2.5 | 4.0 | 5.0 | 1.5 | 5.8 | 2.0 | 0.15 | 0.004 | 0.05 | 0.015 |
| 834 | 6.0 | 10.0 | 1.5 | 5.5 | 4.0 | 0 | 7.0 | 3.0 | 0.15 | 0.004 | 0.05 | 0.015 |
| 835 | 7.0 | 10.0 | 1.5 | 4.0 | 2.0 | 0 | 7.5 | 3.0 | 0.15 | 0.004 | 0.05 | 0.015 |

TABLE III-continued

| ALLOY | ACO[1] | Stress Rupture (parallel to single crystal growth direction) LIFE (HRS) 1600° F./80 Ksi | 1800° F./40 Ksi | 2000° F./20 Ksi | 2100° F./13 Ksi |
|---|---|---|---|---|---|
| 806 | | 85.6 | 43.8 | 57.4 | 22.9 |
| 807 | | 75.7 | 60.1 | 100.3 | 66.4 |
| 808 | | 55.6 | 53.5 | 31.6 | 39.2 |
| 809 | N | 22.0 | 69.6 | 46.0 | 25.3 |
| 810 | | 62.2 | 64.7 | 35.4 | 10.1 |
| 811 | | 101.9 | 161.8 | 44.1 | 8.2 |
| 812 | | 35.1 | 49.1 | 30.2 | 53.5 |
| 813 | | 53.8 | 51.4 | 27.0 | 52.2 |
| 814 | | 57.9 | 63.7 | 42.8 | 47.1 |
| 815 | | 76.5 | 65.4 | 64.8 | 143.2 |
| 816 | | 103.9 | 83.6 | 47.6 | 121.4 |
| 817 | | 24.8 | 55.5 | 42.3 | 55.5 |
| 818 | N | 84.3 | 85.6 | 68.0 | 113.3 |
| 819 | | 147.4 | 115.5 | 100.6 | 264.3 |
| 820 | | 257.2 | 158.7 | 153.7 | 220.1 |
| 821 | | 114.3 | 80.4 | 98.4 | 74.3 |
| 822 | | 64.2 | 70.3 | 43.1 | 96.9 |
| 823 | | 22.3 | 48.7 | — | 46.3 |
| 824 | | 97.1 | 91.9 | | |
| R | | | 118.8 | 67.7 | |
| 825 | | 74.0 | 94.7 | | |
| R | | | 128.4 | 82.3 | |
| 826 | | 113.1 | 119.8 | | |
| R | | | 135.6 | 122.1 | |
| 827 | N | 6.7 | 76.2 | | |
| R | | | 108.4 | 70.0 | |
| 828 | | 119.1 | 72.7 | | |
| R | | | 95.7 | 119.0 | |
| 829 | | 110 | 72.7 | | |
| R | | | 90.2 | 88.0 | |
| 830 | N | 59.8 | 126.5 | | |
| R | | | 162.2 | 147.8 | |
| 831 | | 92.7 | 68.9 | | |
| R | | | 82.1 | 137.6 | |
| 832 | | 90.1 | 58.5 | | |
| R | | | 85.4 | 107.3 | |
| 833 | | 96.5 | 51.6 | | |
| R | | | 69.1 | 132.7 | |
| 834 | | 119.2 | 80.7 | | |
| R | | | 105.7 | 69.1 | |
| 835 | N | 43.5 | 55.3 | | |
| R | | | 67.4 | 27.9 | |

[1]ACO = Acceptable Crystallographic Orientation = single crystal growth orientation within 15° of the [001] zone axis;
N = no, otherwise yes The series III alloys were initially tested at 1600° F./80 ksi and 1800° F./40 ksi. Based on other tests, such as those reported in Table VII, additional test specimens were resolutioned at 2390° F. for two hours, given a more rapid cool and aged at 2050° F./4 hours+1650° F./4 hours, the "R" treatment listed in Table III, and stress rupture tested at 1800° F./40 ksi and 2000° F./20 ksi. The reheat treatment resulted in an average increase in rupture life at 1800° F./40 ksi of about 30%. At the critical parameter of 1800° F./40 ksi for gas turbine engine applications, it is expected that the series I and II alloys would also exhibit a 30% increase in life when given the "R" treatment.

Other experiments have shown that cooling rates from the solutionizing temperature to 2000° F. in the range of 100–600° F./min have only a slight effect on the stress rupture properties of the alloys of the invention with higher rates tending to improve the life at 1800° F./40 ksi slightly. The data are shown in Table IV.

TABLE IV

| Cooling Rate ° F./Min | Stress Rupture Life, Hours 1800° F./40 ksi | 2000° F./20 ksi |
|---|---|---|
| 600 | 91 | 107 |
| 300 | 85 | 123 |
| 100–150 | 75 | 120 |
| Average of all prior data (various cooling rates) | 79 | 100 |

Thus, for the superalloys of the invention, the presently preferred heat treatment is as follows: solutionize in a temperature range sufficient to achieve solutioning of at least 95% of the γ' phase, preferably 2385–2395° F., for 2 hrs., cool to 2000° F. at 100° F./min. minimum, furnace cool to 1200° F. in 60 min. or less and thereafter cool to room temperature; heat to 2050±25° F. for 4 hrs., furnace cool to below 1200° F. in 6 min. or less and thereafter to room temperature; and heat to 1650±25° F. for 4 hrs. and thereafter furnace cool to room temperature. All heat treatment steps are performed in vacuum or an inert atmosphere, and in lieu of the steps calling for cooling to room temperature the treatment may proceed directly to the next heating step.

The stress rupture data from the series I, II, and III alloys indicates that about 5% Re provides the highest rupture strength at 1800° F./40 ksi. The data also show, when rupture life is graphed as a function of rhenium content at constant tungsten contents, that high rupture life at 1800° F./40 ksi can be obtained with rhenium plus tungsten levels in the (3Re+7W) to (5Re+3W) ranges. In the most preferred embodiment, Alloy 821, the presently preferred (Re+W) combination is (3Re+5W) due to the present relative costs of rhenium and tungsten.

All the alloys were evaluated for microstructural stability. Specimens were heat treated by solutionizing at 2375–2400° F./2 hrs. and aging at 1975° F./4 hrs. and at 1650° F./16 hrs. Thereafter, different sets of specimens were heated for 1000 hrs. at 1800° F. and for 1000 hrs. at 2000° F. After preparation, including etching with diluted Murakami's electrolyte, the specimens were examined metallographically and the relative amount of topologically close packed phase (TCP) was determined visually. The series II alloys, except alloys 818 and 819, showed either no TCP precipitation or only traces of precipitation (821) and, as a group, were less prone to microstructural instability than the series III alloys and much less prone than the series I alloys at both 1800° F. and 2000° F.

Table V presents the results of cyclic oxidation tests on uncoated ¼" dia.×3" long pin specimens conducted at 2150° F. using a natural gas flame at Mach 1 gas velocity. The specimens were rotated for uniform exposure and cycled out of the flame once per hour to cool the specimens to room temperature. External metal loss was measured on a section cut transverse to the length dimension of the specimen. Metal loss per side was found by dividing the difference between the pin diameter before and after test by two. The data in the table are the average of two such measurements at 90° to each other across the diameter of the specimen.

The two series I alloys that contained yttrium (802 and 808) had exceptional oxidation resistance. The series II alloys, all of which were yttrium-bearing, exhibited no metal loss after 200 hours of high velocity oxidation (Mach I) at 2150° F. and only 2–3 mils γ' depletion, demonstrating that a synergistic Y+Hf effect was operating. These data also demonstrate that Re improves the oxidation resistance or at least is less detrimental than W which it has replaced in the alloys and, from metallographic studies, also results in improved γ' stability.

TABLE V

| Alloy | Oxidation, 2150° F., Mach 1.0 Metal Loss (mils/side) | | | | | γ' Depletion |
|---|---|---|---|---|---|---|
| Time (hrs) | 18.6 | 62.6 | 127.6 | 169.6 | 214.6 | (mils/side) |
| 800 | 1.0 | 1.8 | 4.8 | 6.8 | 9.3 | 6–12 |
| 801 | 0.8 | 1.5 | 4.8 | 8.0 | 9.8 | 4–8 |
| 802 | 0 | 0 | 0.3 | 0 | 0.3 | 2–3 |
| 803 | 0.8 | 1.5 | 2.8 | 4.0 | 5.8 | 8–10 |
| 804 | 0.8 | 1.3 | 1.5 | 4.0 | 5.3 | 8–12 |
| 805 | 1.0 | 1.5 | 10.3 | 7.5 | 9.5 | 8–10 |
| 806 | 0.8 | 1.8 | 4.8 | 6.3 | 9.8 | 8–10 |
| 807 | 1.0 | 2.0 | 4.5 | 6.3 | 8.0 | 6–8 |
| 808 | 0.3 | 0 | 0.3 | 0.3 | 0.5 | 2–3 |
| 809 | 1.0 | 1.8 | 2.8 | 2.0 | 4.3 | 10–14 |
| 810 | 1.0 | 1.8 | 2.8 | 3.5 | 4.0 | 10–16 |
| 811 | 1.3 | 2.5 | 3.0 | 4.5 | 5.5 | 12–16 |
| 812 | 0 | 0 | 0 | 0 | 0 | 1–2 |
| 813 | 0 | 0 | 0 | 0 | 0 | 1–2 |
| 814 | 0 | 0 | 0 | 0 | 0 | 1–2 |
| 815 | 0 | 0 | 0 | 0 | 0 | 1–2 |
| 816 | 0 | 0 | 0 | 0 | 0 | 1 |
| 817 | 0 | 0 | 0 | 0 | 0 | 1 |
| 818 | 0 | 0 | 0 | 0 | 0 | 2 |
| 819 | 0 | 0 | 0 | 0 | 0 | 2 |
| 820 | 0 | 0 | 0 | 0 | 0 | 2 |
| 821 | 0 | 0 | 0 | 0 | 0 | 1–2 |
| 822 | 0 | 0 | 0 | 0 | 0 | 1–2 |
| 823 | 0 | 0 | 0 | 0 | 0 | 1–2 |
| R125 | — | — | — | — | 80 | — |
| R80 | — | — | — | — | 90 | — |
| MA754 | — | — | — | — | 12 | — |

The hot corrosion resistance of the alloys of the invention was evaluated alongside three alloys used to produce production turbine blades, Rene' 125, B1900, and MM200(Hf), in tests wherein specimens of the alloys were exposed to a JP-5 fuel-fired flame at 1600° F. with a nominal 1 ppm salt added to the combustion products. The test was first run at ~1 ppm for 1040 hrs., and then at ~2 ppm, for 578 hrs. The chemical determination of NaCl on calibration pins at every 200 hours indicated that the salt level was between 0 and 1 ppm during the first 1000 hours, between 1 and 2 ppm during the next 300–400 hours and about 2 ppm during the remaining 300 hours. The following conclusions were drawn from these hot corrosion tests: 1) B1900 was least resistant to hot corrosion at all salt levels, 2) MM200(Hf) was the next least resistant alloy at all salt levels, 3) the alloys of the invention, especially alloy 821, and Rene'125 exhibit similar hot corrosion behavior, with the alloys of the invention being slightly less resistant than Rene' 125, and 4) as is the case for Rene' 125 and other alloys, the alloys of the invention appear to be sensitive to salt level in the corrosion test with increased salt level resulting in poorer corrosion resistance. Thus, the difference between B1900, MM200(Hf), Rene' 125, and the alloys of the invention narrows at high salt levels. These results are consistent with prior experience and indicate that the hot corrosion resistance of the alloys of the invention will be adequate for applications where Rene' 125 equivalency is required.

Alloy 821 was scaled up as a 300 lb master heat having the composition given in Table VI. No yttrium was added to the master heat; rather, yttrium was added when the master heat material was remelted and molten prior to DS'ing to produce single crystal slabs and turbine blades. For the test specimens used to obtain the data of Tables VII, VIII, IX, and X, yttrium in the amount of 400 ppm was added. Stress rupture strength data for alloy 821 from the 300 lb master heat and the 12 lb. laboratory heat are presented in Table IX.

TABLE VI

| 300 Lb Alloy 821 Master Heat | | | |
|---|---|---|---|
| Cr | 6.79 | Ti | 0 |
| Co | 7.30 | Re | 2.95 |
| Mo | 1.48 | Hf | 0.17 |
| W | 4.95 | C | 0.05 |
| Ta | 6.40 | B | 0.004 |
| Al | 6.15 | Y | 0 |

TABLE VII

| Stress Rupture Data | | | | | | |
|---|---|---|---|---|---|---|
| Heat | H. Treat | Temp (° F.) | Stress (ksi) | Life (Hrs) | E1 (%) | RA (%) |
| 12 lb Lab. Ht. | 2390/2 + 1975/4 + 1650/16 H.T. as slabs | 1600 | 80 | 114.3 | | |
| | | 1800 | 40 | 80.4 | | |
| | | 2000 | 20 | 98.4 | 7.7 | 43.1 |
| | | 2100 | 13 | 74.3 | 16.8 | 6.8 |
| 300 lb Master Ht. Alloy 821 | 2390/2 + 1975/4 + 1650/16 H.T. as slabs | 1400 | 130 | 1.9 | 19.5 | 26.9 |
| | | 1400 | 110 | 351.6 | 14.8 | 24.4 |
| | | 1600 | 80 | 155.4 | 20.1 | 26.8 |
| | | 1800 | 40 | 72.7 | 39.4 | 29.9 |
| | | 1800 | 40 | 75.8 | 20.6 | 33.2 |
| | | 1800 | 35 | 227.8 | 17.5 | 27.3 |
| | | 1800 | 30 | 509.2 | 16.8 | 28.7 |
| | | 1900 | 25 | 120.2 | 10.1 | 23.4 |
| | | 1900 | 22 | 357.2 | 13.9 | 28.6 |
| | | 2000 | 20 | 81.3 | 13.6 | 38.5 |
| | | 2000 | 17.5 | 391.9 | 13.1 | 23.3 |
| | | 2100 | 13 | 80.5 | 3.4 | 48.6 |
| 300 lb Alloy 821 | Reheat treated* + 1900/4 age + 1650/4 age | 1600 | 80 | 115.8 | 19.0 | 25.0 |
| | | 1800 | 40 | 68.4 | 17.0 | 30.5 |
| | | 2000 | 20 | 82.7 | 13.9 | 35.2 |
| | Reheat treated* + 1975/4 age + 1650/4 age | 1600 | 80 | 155.2 | 19.0 | 26.2 |
| | | 1800 | 40 | 85.2 | 25.5 | 39.0 |
| | | 2000 | 20 | 101.2 | 14.7 | 34.4 |
| | Reheat treated* + 2050/4 age + 1650/4 age | 1600 | 80 | 160.0 | 18.9 | 27.5 |
| | | 1800 | 40 | 103.8 | 18.1 | 28.3 |
| | | 2000 | 20 | 125.7 | 11.6 | 40.3 |
| | Reheat treated* + 2125/1 age + 1975/4 (coating simulation) + 1650/4 age | 1600 | 80 | 139.9 | 19.3 | 24.0 |
| | | 1800 | 40 | 97.4 | 23.2 | 28.6 |
| | | 2000 | 20 | 126.9 | 12.8 | 32.9 |
| | Reheat treated* + 2200/1 age + 1975/4 (coating simulation) + 1650/4 age | 1600 | 80 | 131.0 | 17.8 | 24.7 |
| | | 1800 | 40 | 90.5 | 20.6 | 29.8 |
| | | 2000 | 20 | 97.2 | 12.4 | 31.1 |

*All resolutioned in test specimen form at 2390° F./2 hr + fast cool to 2000° F.

Tensile strength, low cycle fatigue and high cycle fatigue tests were performed on single crystal material from the 300 lb heat of alloy 821 solutioned at 2390° F./2 hrs. and aged at 1975° F./4 hrs. and 1650° F./16 hrs., with the results shown in Tables VIII, IX, and X, respectively, where UTS is ultimate tensile strength; YS is yield strength at 0.2% strain offset; El is elongation; and RA is reduction in area.

TABLE VIII

Tensile Data (Master Heat Alloy 821)

| Temp (° F.) | UTS (Ksi) | 0.2% YS (Ksi) | 0.02% YS (Ksi) | E1 (%) | RA (%) |
|---|---|---|---|---|---|
| 1000 | 128.6 | 113.4 | 110.7 | 11.6 | 18.9 |
| 1200 | 129.6 | 112.4 | 106.5 | 14.2 | 19.9 |
| 1400 | 142.8 | 112.8 | 102.6 | 9.9 | 13.3 |
| 1600 | 143.3 | 129.4 | 103.5 | 18.0 | 30.8 |
| 1800 | 110.1 | 94.7 | 71.9 | 10.0 | 28.1 |
| 2000 | 64.1 | 51.2 | 39.2 | 19.1 | 21.6 |

TABLE IX

Low Cycle Fatigue (Master Heat Alloy 821)

| Alternating Pseudostress (ksi)[1] | Cycles to Failure $N_f$ |
|---|---|
| 21 | $4.9 \times 10^3$ |
| 31 | $2.3 \times 10^3$ |
| 37 | $2.5 \times 10^3$ |

[1]2 min. compressive strain hold, 2000° F.

TABLE X

High Cycle Fatigue[1] (Master Heat Alloy 821)

| Alternating Stress (ksi) | Cycles to Failure $N_f$ |
|---|---|
| 10 | $9.6 \times 10^6$ |
| 11 | $4.4 \times 10^6$ |
| 13 | $1.4 \times 10^6$ |
| 15 | $0.5 \times 10^6$ |

[1]2050° F.
A = 0.67, 30 Hz

As discussed at greater length in co-pending co-assigned application Ser. No. 595,854, the superalloys of this invention break with the long-standing wisdom of the single crystal superalloy arts that grain boundary strengthening elements such as B, Zr and C are to be avoided, i.e., kept to the lowest levels possible consistent with commercial melting and alloying practice and technology. One general reason given for restricting such elements is to increase the incipient melting temperature in relation to the γ' solves temperature thus permitting solutionizing heat treatments to be performed at temperatures where complete solutionizing of the γ' phase is possible in reasonable times without causing localized melting of solute-rich regions. Another is to minimize or preclude the formation of deleterious TCP phases.

As noted in the Ser. No. 595,854 application, single crystal articles are not necessarily wholly of a single crystal as there may be present therein grain boundaries referred to as low angle grain boundaries wherein the crystallographic mismatch across the boundary is generally accepted to be less than about 5 to 6 degrees. Low angle grain boundaries are to be distinguished from high angle grain boundaries which are generally regarded as boundaries between adjacent grains whose crystallographic orientation differs by more than about 5–6 degrees. High angle grain boundaries are regions of high surface energy, i.e., on the order of several hundreds of ergs/cm$^2$, and of such high random misfit that the structure cannot easily be described or modeled.

As also noted therein, the discovery that small, but controlled, amounts of such previously prohibited elements can be tolerated resulted in the single crystal superalloys of the Ser. No. 595,854 application which have improved tolerance to low angle grain boundaries, i.e., have greater grain boundary strength than the state-of-the-art single crystal superalloys. As one result of this increased grain boundary strength, grain boundary mismatches far greater than the 6° limit for prior art single crystal superalloy articles can be tolerated in single crystal articles made from the nickel-base superalloys of that invention. This translates, for example, into better in-service reliability, lower inspection costs and higher yields as grain boundaries over a broader range can be accepted by the usual inspection techniques. The novel features of that invention have been embodied in the novel superalloys of the present invention; thus, the superalloys of the present invention also exhibit improved tolerance to low angle grain boundaries and also have the above-described benefits.

The superalloys of this invention are also alloyed with yttrium which renders them more highly reactive with respect to ceramic molds and cores used in the investment casting process than nickel-base superalloys not alloyed with yttrium. Ceramic/metal instability is controlled by the bulk thermodynamic condition of the system. The more negative the free energy of formation, $\Delta G^\circ_f$, the greater the affinity for oxygen. It has been found that the free energy of formation for oxides becomes more negative as more reactive elements, such as yttrium, are added resulting in a greater potential for metal/ceramic reaction than when typical $SiO_2$ and $ZrO_2$ ceramic mold and core systems are used. Based on thermodynamic considerations and the work reported in U.S. Department of the Air Force publication AFML-TR-77-211, "Development of Advanced Core and Mold Materials for Directional Solidification of Eutectics" (1977), alumina is less reactive and is, therefore, a preferred material for molds, cores and face coats when casting superalloys containing reactive elements.

It has also been found that melt/mold and core interactions are decreased, the retention of yttrium increased and the uniformity of yttrium distribution improved by the use of low investment casting parameters and temperatures. This translates to the use of the lowest possible superheat and mold preheat and a high withdrawal rate in the casting of the single crystal articles of this invention.

Several unscored small turbine blades were investment cast using alloy 821 material from the previously mentioned 300 lb scale-up master heat. Those blades measured about 1.5" from tip to root with a span of approximately 0.75". Blade tip to platform distance was 1". As noted earlier, yttrium was added to the master heat material while molten and prior to DS'ing—in this case the amount was 2000 ppm. In general, most blades exhibited acceptable crystal structure and, as shown in Table XI, those cast using low casting parameters had better yttrium retention. Also, it appeared that surface to volume ratio influences yttrium retention; as the ratio increases, the yttrium retention decreases. This is illustrated by comparison of yttrium retention at the leading and trailing edges; the surface to volume ratio is lower in the leading edge compared to the trailing edge, and the yttrium retention in the leading edge is consistently higher than at the trailing edge.

TABLE XI

| Casting | Yttrium Content (ppm) | | | | |
|---|---|---|---|---|---|
| | Airfoil Tip | | Airfoil Near Platform | | Blade Root |
| Condition | LE[1] | TE[2] | LE | TE | ROOT[3] |
| Low | 130 | 100 | 160 | 100 | 130 |
| Superheat | 90 | 60 | 80 | 50 | 160 |
| | 190 | 120 | 190 | 150 | 190 |
| | 170 | 90 | 180 | 150 | 200 |
| | 410 | 330 | 470 | 360 | 380 |
| | 310 | 120 | 270 | 160 | 280 |
| High | 80 | 60 | 120 | 70 | 100 |
| Superheat | 80 | 80 | 100 | 70 | 130 |
| | 100 | 90 | 90 | 150 | 100 |
| | 80 | 60 | 100 | 100 | 100 |
| | 130 | 150 | 190 | 150 | 120 |
| | 170 | 200 | 240 | 210 | 170 |

[1]LE = leading edge
[2]TE = trailing edge
[3]ROOT = root, center

Additional single crystal investment castings of large solid turbine blades (4¾" tip-to-root) and small and large turbine blades having cores therein to define serpentine passageways for the provision of cooling air were also made. The large solid turbine blades required late yttrium additions of up to 2400 ppm in order to obtain yttrium distributions within the desired 50–300 ppm level. Similar such levels, coupled with the use of low investment casting parameters, were required to obtain acceptable yttrium levels in the cored blades. As was the case with the uncored small turbine blades, the effect of surface to volume ratio was evident; the leading edge retained higher yttrium levels compared to the trailing edge.

Although the present invention has been described in connection with specific examples, it will be understood by those skilled in the art that the present invention is capable of variations and modifications within the scope of the invention as represented by the appended claims.

What is claimed is:

1. A nickel-base single-crystal superalloy article consisting essentially of, in percentages by weight, 5–10 Cr, 5–10 Co, 0–2 Mo, 3–8 W, 3–8 Ta, 0–2 Ti, 5–7 Al, Re in an amount of up to 6, 0.08 to 0.2 Hf, 0.03–0.07 C, 0.003–0.006 B, and 0.0–0.04 Y, the balance being nickel and incidental impurities.

2. The superalloy article of claim 1 consisting essentially of, in percentages by weight, 6.75–7.25 Cr, 7.0–8.0 Co, 1.3–1.7 Mo, 4.75–5.25 W, 6.3–6.7 Ta, 0.02 max. Ti, 6.0–6.4 Al, 2.75–3.25 Re, 0.12–0.18 Hf, 0.04–0.06 C, 0.003–0.005 B, and 0.005–0.02 Y, the balance being nickel and incidental impurities.

3. The superalloy article of claim 2 consisting essentially of, in percentages by weight, 7 Cr, 7.5 Co, 1.5 Mo, 5 W, 6.5 Ta, 0 Ti, 6.2 Al, 3 Re, 0.15 Hf, 0.05 C, 0.004 B, and 0.01 Y, the balance being nickel and incidental impurities.

4. The superalloy article of claim 1, wherein the Co and Re contents are, in percentages by weight, 5–8 and up to 3.25, respectively.

5. The superalloy article of claim 1, wherein the Cr and W contents are, in percentages by weight, 5–9.75 and 3–7, respectively.

6. The superalloy article of claim 1, wherein the article is an airfoil member for a gas turbine engine.

7. The superalloy article of claim 2, wherein the article is an airfoil member of a gas turbine engine.

8. The superalloy article of claim 3, wherein the article is an airfoil member of a gas turbine engine.

9. The superalloy article of claim 4, wherein the article is an airfoil member of a gas turbine engine.

10. The superalloy article of claim 5, wherein the article is an airfoil member of a gas turbine engine.

11. The superalloy article of claim 1, wherein the superalloy has a gamma prime content of up to 60 volume percent.

12. The superalloy article of claim 1, wherein the superalloy is substantially free of a topologically close-packed phase that would cause microstructural instability.

13. The superalloy article of claim 1, wherein the superalloy exhibits no metal loss after 200 hours of high-velocity oxidation testing at about 2150° F. with a gas velocity of Mach 1 and cooling to room temperature once each hour.

14. The superalloy article of claim 1, wherein the superalloy has a grain boundary mismatch of greater than 6 degrees.

15. The superalloy article of claim 1, wherein the Y content is, in percentage by weight, 0.005–0.03.

16. The superalloy article of claim 1, wherein the Y content is about 0 weight percent.

17. A gas turbine blade case from a nickel-base single-crystal superalloy consisting essentially of, in percentages by weight, 5–10 Cr, 5–10 Co, 0–2 Mo, 3–8 W, 3–8 Ta, 0–2 Ti, 5–7 Al, Re in an amount of up to 6, 0.08 to 0.2 Hf, 0.03–0.07 C, 0.003–0.006 B, and 0.0–0.04 Y, the balance being nickel and incidental impurities.

18. The gas turbine blade of claim 17, wherein the Co and Re contents are, in percentages by weight, 5–8 and up to 3.25, respectively.

19. The gas turbine engine component of claim 17, wherein the Cr and W contents are, in percentages by weight, 5–9.75 and 3–7, respectively.

20. The gas turbine engine component of claim 17, wherein the superalloy has a gamma prime content of up to 60 volume percent.

21. The gas turbine engine component of claim 18, wherein the superalloy has a gamma prime content of up to 60 volume percent.

22. The gas turbine engine component of claim 19, wherein the superalloy has a gamma prime content of up to 60 volume percent.

23. The gas turbine engine component of claim 17, wherein the superalloy is substantially free of a topologically close-packed phase that would cause microstructural instability.

24. The gas turbine engine component of claim 18, wherein the superalloy is substantially free of a topologically close-packed phase that would cause microstructural instability.

25. The gas turbine engine component of claim 19, wherein the superalloy is substantially free of a topologically close-packed phase that would cause microstructural instability.

26. The gas turbine engine component of claim 17, wherein the superalloy exhibits no metal loss after 200 hours of high-velocity oxidation testing at about 2150° F. with a gas velocity of Mach 1 and cooling to room temperature once each hour.

27. The gas turbine engine component of claim 18, wherein the superalloy exhibits no metal loss after 200 hours of high-velocity oxidation testing at about 2150° F. with a gas velocity of Mach 1 and cooling to room temperature once each hour.

28. The gas turbine engine component of claim 19, wherein the superalloy exhibits no metal loss after 200 hours of high-velocity oxidation testing at about 2150° F. with a gas velocity of Mach 1 and cooling to room temperature once each hour.

29. The gas turbine engine component of claim 17, wherein the superalloy has a grain boundary mismatch of greater than 6 degrees.

30. The gas turbine engine component of claim 18, wherein the superalloy has a grain boundary mismatch of greater than 6 degrees.

31. The gas turbine engine component of claim 19, wherein the superalloy has a grain boundary mismatch of greater than 6 degrees.

32. The gas turbine engine component of claim 17, wherein the Y content is, in percentage by weight, 0.005–0.03.

33. The gas turbine engine component of claim 18, wherein the Y content is, in percentage by weight, 0.005–0.03.

34. The gas turbine engine component of claim 19, wherein the Y content is, in percentage by weight, 0.005–0.03.

35. The gas turbine engine component of claim 17, wherein the Y content is about 0 weight percent.

36. The gas turbine engine component of claim 18, wherein the Y content is about 0 weight percent.

37. The gas turbine engine component of claim 19, wherein the Y content is about 0 weight percent.

38. A gas turbine engine component cast from a nickel-base single-crystal superalloy consisting essentially of, in percentages by weight, 6.75–7.25 Cr, 7.0–8.0 Co, 1.3–1.7 Mo, 4.75–5.25 W, 6.3–6.7 Ta, 0.02 max. Ti, 6.0–6.4 Al, 2.75–3.25 Re, 0.12–0.18 Hf, 0.04–0.06 C, 0.003–0.005 B, and 0.005–0.02 Y, the balance being nickel and incidental impurities.

39. The gas turbine engine component of claim 38, wherein the superalloy has a gamma prime content of up to 60 volume percent.

40. The gas turbine engine component of claim 38, wherein the superalloy is substantially free of a topologically close-packed phase that would cause microstructural instability.

41. The gas turbine engine component of claim 38, wherein the superalloy exhibits no metal loss after 200 hours of high-velocity oxidation testing at about 2150° F. with a gas velocity of Mach 1 and cooling to room temperature once each hour.

42. The gas turbine engine component of claim 38, wherein the superalloy has a grain boundary mismatch of greater than 6 degrees.

43. The gas turbine engine component cast from a nickel-base single-crystal superalloy consisting essentially of, in percentages by weight, 7 Cr, 7.5 Co, 1.5 Mo, 5 W, 6.5 Ta, 0 Ti, 6.2 Al, 3 Re, 0.15 Hf, 0.05 C, 0.004 B, and 0.01 Y, the balance being nickel and incidental impurities.

44. The gas turbine engine component of claim 43, wherein the superalloy has a gamma prime content of up to 60 volume percent.

45. The gas turbine engine component of claim 43, wherein the superalloy is substantially free of a topologically close-packed phase that would cause microstructural instability.

46. The gas turbine engine component of claim 43, wherein the superalloy exhibits no metal loss after 200 hours of high-velocity oxidation testing at about 2150° F. with a gas velocity of Mach 1 and cooling to room temperature once each hour.

47. The gas turbine engine component of claim 43, wherein the superalloy has a grain boundary mismatch of greater than 6 degrees.

* * * * *